US010072466B2

(12) United States Patent
Persent et al.

(10) Patent No.: US 10,072,466 B2
(45) Date of Patent: Sep. 11, 2018

(54) RISER PIPE SECTION EQUIPPED WITH AN INNER LOCKING RING AND WITH A CLEARANCE ADJUSTMENT MEANS BETWEEN THE AUXILIARY LINE ELEMENTS AND THE MAIN TUBE ELEMENTS

(71) Applicant: IFP Energies nouvelles, Rueil-Malmaison (FR)

(72) Inventors: Emmanuel Persent, Croissy sur Seine (FR); Navid Saeedi, Alfortville (FR); Gerard Papon, Les Essarts le Roi (FR)

(73) Assignee: IFP Energies nouvelles, Rueil-Malmaison (FR)

( * ) Notice: Subject to any disclaimer, the term of this patent is extended or adjusted under 35 U.S.C. 154(b) by 0 days.

(21) Appl. No.: 15/309,115

(22) PCT Filed: Apr. 16, 2015

(86) PCT No.: PCT/EP2015/058269
§ 371 (c)(1),
(2) Date: Nov. 4, 2016

(87) PCT Pub. No.: WO2015/169559
PCT Pub. Date: Nov. 12, 2015

(65) Prior Publication Data

US 2017/0074053 A1 Mar. 16, 2017

(30) Foreign Application Priority Data

May 5, 2014 (FR) ..... 14 54056

(51) Int. Cl.
*E21B 17/08* (2006.01)
*E21B 17/01* (2006.01)

(52) U.S. Cl.
CPC ..... *E21B 17/085* (2013.01); *E21B 17/01* (2013.01)

(58) Field of Classification Search
CPC ..... E21B 17/085; E21B 17/01; E21B 17/046
See application file for complete search history.

(56) References Cited

U.S. PATENT DOCUMENTS 3,198,555 A * 8/1965 Johnson ..... E21B 17/046 285/330
4,280,719 A * 7/1981 Daniel ..... E21B 33/038 285/377

(Continued)

FOREIGN PATENT DOCUMENTS

FR 2839339 A1 11/2003
FR 2925105 A1 6/2009

(Continued)

OTHER PUBLICATIONS

International Search Report for PCT/EP2015/058269 dated Jul. 16, 2015; English translation submitted herewith (7 Pages).

*Primary Examiner* — Matthew R Buck
*Assistant Examiner* — Aaron L Lembo
(74) *Attorney, Agent, or Firm* — Fitch, Even, Tabin & Flannery, LLP

(57) ABSTRACT

The present invention relates to a riser section (4) equipped with an inner locking ring (11). According to the invention, auxiliary line elements (7) are secured to one end of main tube (6) and they are mobile with respect to the other end of main tube (6) through the agency of a sliding pivot connection, whose relative translational motion is limited by a clearance adjustment means (15). The invention also relates to a riser consisting of several sections (4) and to the use of the riser for carrying out an offshore drilling operation.

20 Claims, 10 Drawing Sheets

(56) References Cited

U.S. PATENT DOCUMENTS 4,491,346 A 1/1985 Walker
4,603,886 A * 8/1986 Pallini, Jr. ..... E21B 17/085 285/18
4,919,221 A * 4/1990 Pascale ..... E21B 10/36 173/132
5,634,671 A * 6/1997 Watkins ..... E21B 17/085 166/344
6,123,151 A * 9/2000 Regan ..... E21B 21/001 166/364
7,096,940 B2 * 8/2006 Baxter ..... E21B 17/1085 166/241.6
7,341,281 B2 * 3/2008 Guesnon ..... F16L 37/107 285/314
7,686,087 B2 * 3/2010 Pallini ..... E21B 17/085 166/338
8,616,286 B2 * 12/2013 Papon ..... E21B 17/01 166/338
8,733,452 B2 * 5/2014 Guesnon ..... E21B 17/085 166/341
8,881,830 B2 * 11/2014 Papon ..... E21B 17/085 166/345
9,109,405 B2 * 8/2015 Carbaugh ..... E21B 17/085
9,453,375 B2 * 9/2016 Hoefler ..... E21B 17/085
9,650,845 B2 * 5/2017 Shield ..... E21B 17/085
2003/0111799 A1 * 6/2003 Gilmore ..... E21B 17/07 277/510
2003/0205380 A1 11/2003 Guesnon et al.
2010/0300699 A1 * 12/2010 Papon ..... E21B 17/01 166/367
2010/0319925 A1 12/2010 Papon et al.
2011/0017466 A1 * 1/2011 Averbuch ..... E21B 17/085 166/345
2011/0037257 A1 * 2/2011 Walker ..... E21B 17/01 285/337
2011/0127041 A1 * 6/2011 Edwards ..... E21B 17/06 166/365
2011/0203804 A1 8/2011 Guesnon et al.
2013/0020087 A1 1/2013 Guesnon et al.
2015/0343540 A1 * 12/2015 Hoop ..... B28D 1/041 408/204
2016/0258562 A1 * 9/2016 Bjoerneklett ..... E21B 17/01
2017/0089149 A1 * 3/2017 Yao ..... E21B 17/046

FOREIGN PATENT DOCUMENTS

FR 2956693 A1 8/2011
FR 2956694 A1 8/2011
WO 2011/104629 A1 9/2011
WO 2015/071411 A2 5/2015

* cited by examiner

RISER PIPE SECTION EQUIPPED WITH AN INNER LOCKING RING AND WITH A CLEARANCE ADJUSTMENT MEANS BETWEEN THE AUXILIARY LINE ELEMENTS AND THE MAIN TUBE ELEMENTS

CROSS-REFERENCE TO RELATED APPLICATIONS

This application is a U.S. national phase application filed under 35 U.S.C. § 371 of International Application No. PCT/EP2015/058269, filed Apr. 16, 2015, designating the United States, which claims priority from French Patent Application Ser. No. 14/54.056, filed May 5, 2014, which are hereby incorporated herein by reference in their entirety for all purposes.

FIELD OF THE INVENTION

The present invention relates to the field of very deep sea oil reservoir drilling and development. It concerns a riser pipe section.

BACKGROUND OF THE INVENTION

A riser is made up of an assembly of tubular elements of length ranging between 15 and 27 m (50 and 90 feet), assembled by connectors. The tubular elements generally consist of a main tube provided with connectors at each end. Tubular auxiliary lines, also called peripheral lines, commonly referred to as "kill line", "choke line", "booster line" and "hydraulic line", allowing circulation of technical fluids, are provided parallel to the main tube. The tubular elements are assembled on the drilling site, from a floater. The riser is lowered into the water depth as the tubular elements are assembled, until it reaches the wellhead located on the sea bottom.

In the perspective of drilling at water depths that can reach 3500 m or more, the weight of the riser becomes very penalizing. This phenomenon is increased by the fact that, for the same maximum working pressure, the length of the riser requires a larger inside diameter for the auxiliary lines, considering the necessity to limit pressure drops.

Besides, the necessity to decrease the riser assembly time is all the more critical since the water depth, and therefore the riser length, is great.

Documents FR-2,925,105, FR-2,956,693 and FR-2,956,694 describe various solutions notably aiming to involve the auxiliary lines, together with the main tube, in the taking up of the longitudinal stresses applied to the riser. However, for the systems described in these patents, fastening of the auxiliary lines with respect to the main tube leads to high tensile stresses in the auxiliary lines. In order to withstand these tensile stresses, the auxiliary lines have great thickness values, which generates an increase in the mass and size of the floats, and therefore in the cost of the riser.

The present invention describes a solution providing a compact connector design by means of an inner locking ring. According to the invention, the auxiliary lines are mobile through the agency of a sliding pivot connection, whose relative motion is limited by a clearance adjustment means. The connectors according to the invention are well suited for deep-sea risers, i.e. located at depths greater than 2000 meters. Thus, the auxiliary line thickness can be reduced, which allows gains in the mass of the floaters, the total mass of the riser and the cost of the riser.

SUMMARY OF THE INVENTION

The invention relates to a riser section comprising a main tube element extended by a male connector element and by a female connector element comprising a first series of studs on the inner face thereof, wherein a locking ring is mounted on said male connector element, the outer surface of said locking ring comprising at least a second series of studs, said riser section additionally comprising at least one auxiliary line element. Said auxiliary line element is secured to one end of said main tube element and it is connected by a sliding pivot connection to the other end of said main tube element, said sliding pivot connection allowing a relative translational motion between said main tube element and said auxiliary line element over a distance limited by a clearance adjustment means arranged on said auxiliary line element.

According to the invention, said clearance adjustment means consists of a nut or a threaded part.

According to a variant embodiment, said auxiliary line element is extended on the one hand by a female end piece and on the other hand by a male end piece provided with a nut.

According to a second variant embodiment, said auxiliary line element is extended on the one hand by a female end piece and on the other hand by a receptacle in which a male pin provided with a stop is inserted.

Alternatively, said auxiliary line element is extended on the one hand by a receptacle in which a female pin is inserted and on the other hand by a receptacle in which a male threaded pin is screwed, said male threaded pin comprising a shoulder.

According to an aspect of the invention, the distance limited by said clearance adjustment means ranges between 0 mm and 38.1 mm, preferably between 2.54 mm and 25.4 mm.

Advantageously, said male connector element comprises a sleeve on which said locking ring is mounted.

Preferably, said male connector element comprises a third series of studs on the inner face thereof, and the outer surface of said locking ring comprises a fourth series of studs suited to cooperate with said third series of studs.

Advantageously, each series of studs is made up of at least two rows of at least four studs.

Furthermore, said auxiliary line element can be a hooped steel tube with reinforcement wires such as glass, carbon or aramid fibers, coated with a polymer matrix.

According to an embodiment, said male and female connector elements extend the main tube element by increasing the section and the thickness of said main tube element so as to form flanges for passage of said auxiliary line element.

Advantageously, said sliding pivot connection is achieved in a flange of said male connector element.

According to an aspect of the invention, said riser section comprises a locking collar cooperating with the peripheral surfaces of said flanges for assembling said flanges.

Preferably, the inner face of said locking collar is provided with a first series of studs and the peripheral surface of the flange of said female connector element comprises a second series of studs.

Advantageously, the inner face of said locking collar is provided with a third series of studs and the peripheral surface of the flange of said male connector element comprises a fourth series of studs suited to cooperate with said third series of studs.

Furthermore, said locking collar can be rotationally secured to said locking ring.

Besides, the invention relates to a riser pipe comprising at least two riser sections according to the invention, for which the connection between two consecutive sections is achieved by means of said male and female connector elements and of said locking ring.

Advantageously, said distance of the relative translational motion of said sliding pivot connection is adjusted so as to be positive upon connection of at least two sections of said riser and to be zero while using said riser.

The invention also relates to the use of a riser according to the invention for carrying out an offshore drilling operation.

BRIEF DESCRIPTION OF THE FIGURES

Other features and advantages of the method according to the invention will be clear from reading the description hereafter of embodiments given by way of non limitative example, with reference to the accompanying figures wherein.

DETAILED DESCRIPTION OF THE INVENTION

Figure 1:
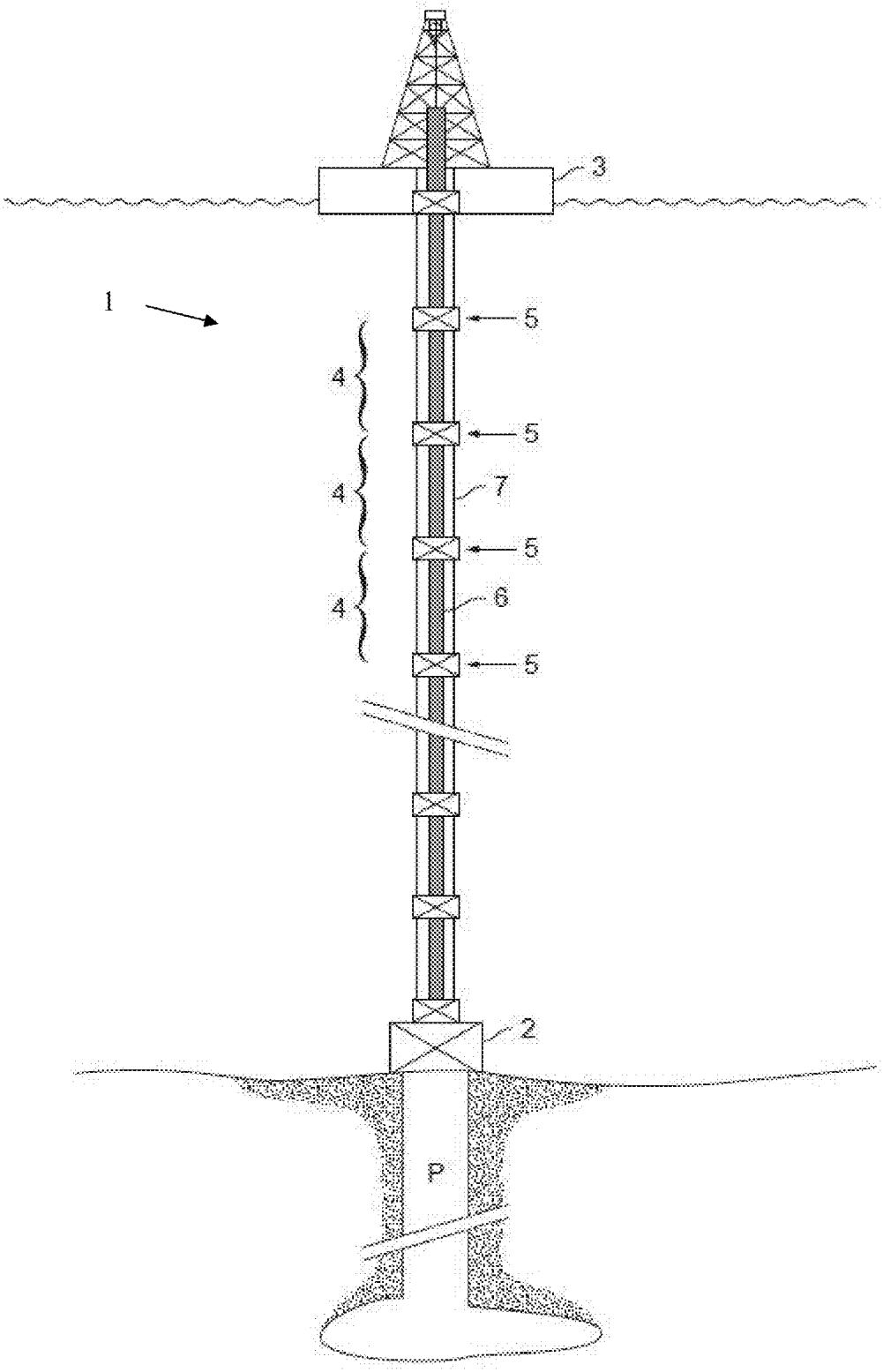
FIG. 1 diagrammatically shows a riser according to the invention.

FIG. 1 diagrammatically shows an offshore riser pipe 1. Riser 1 extends well P and it stretches from wellhead 2 to a floater 3, a platform or a vessel for example. Wellhead 2 is provided with a preventer commonly referred to as B.O.P. or Blow-Out Preventer. Riser 1 is made up of an assembly of several sections 4 assembled end to end by connectors 5. Each section consists of a main tube element 6 provided with at least one auxiliary line element 7, also referred to as peripheral line. Auxiliary lines referred to as kill lines or choke lines are used to provide well safety during control procedures relative to the inflow of fluids under pressure in the well. The line referred to as choke line is a safety line carrying fluids (oil, water, gas) coming from the well in the event of an inflow and driving them towards the choke manifold and the flare. The line referred to as kill line is a safety line enabling injection into the well of heavy fluids and cements allowing an otherwise uncontrollable blowout to be stopped. The line referred to as booster line allows mud to be injected into the well in order to increase the annulus velocity thereof and to prevent sedimentation of the cuttings; it is also used for replacing the mud contained in the riser by water prior to disconnection. The line referred to as hydraulic line allows the wellhead preventer to be controlled. Hydraulic lines allow the BOP safety devices (valves and accumulators) to be supplied with hydraulic fluid (glycol-laden distilled water) under pressure.

Figure 2:
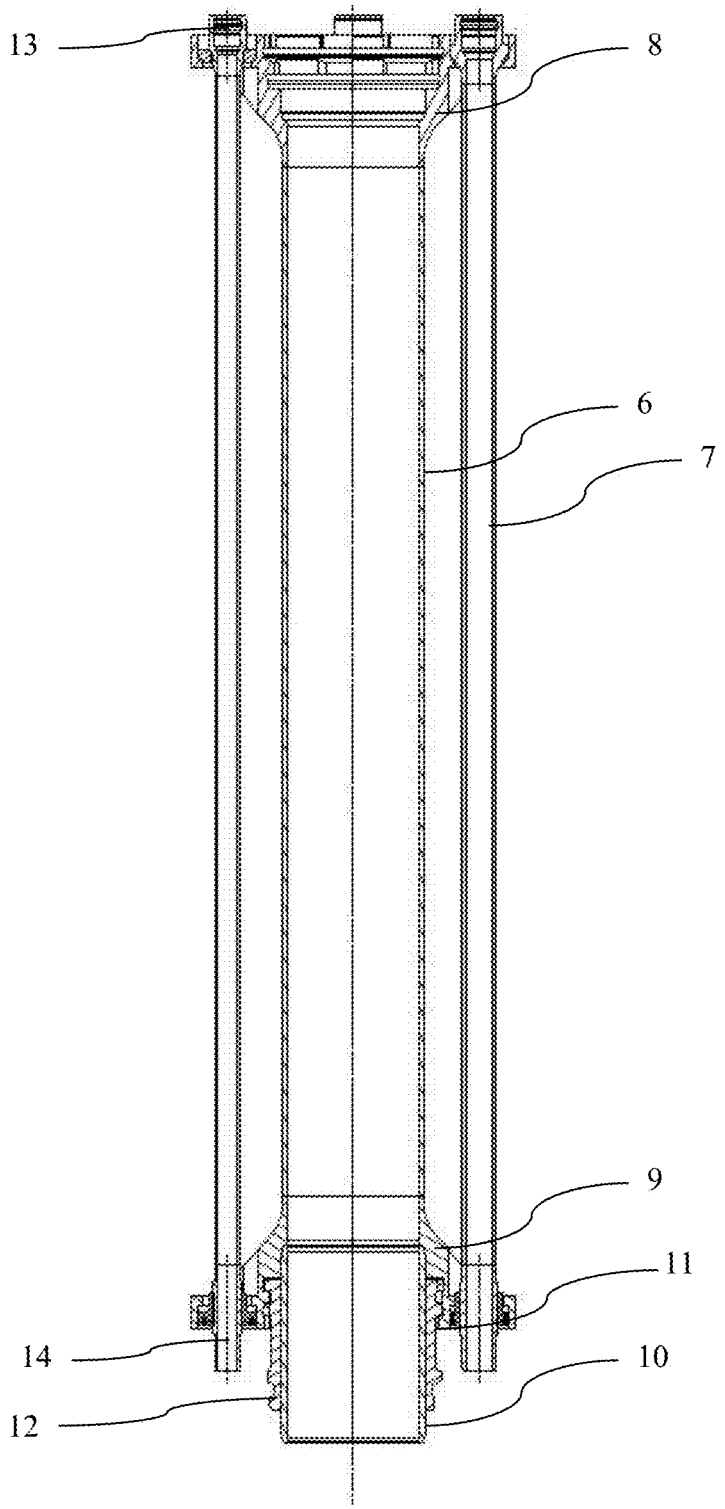
FIG. 2 illustrates a riser section according to an embodiment of the invention.

FIG. 2 diagrammatically shows a section 4 of the riser according to an embodiment of the invention. Section 4 comprises a main tube element 6 whose axis forms the axis of the riser. Auxiliary tubes 7 make up auxiliary lines or ducts arranged parallel to the axis of the main tube. Auxiliary line elements 7 have lengths substantially equal to the length of main tube element 6, generally ranging between 10 and 30 meters. There is at least one line 7 arranged on the periphery of the main tube. In FIG. 2, two lines 7 are shown.

A connector 5 shown in FIG. 1 consists of two elements designated, in reference to FIG. 2, by female connector element 8 and male connector element 9. Connector elements 8 and 9 are mounted at the ends of main tube element 6. Female connector element 8 is secured to tube 6, for example by welding, by screwing, by crimping or by clamping linkage. Male connector element 9 is secured to tube 6, for example by welding, by screwing, by crimping or by clamping linkage. The assembly of male connector element 9 with a female connector element 8 of another section forms connector 5 that transmits stresses from one riser section to the next section, notably the longitudinal stresses undergone by the riser.

Connector 5 can be designed and dimensioned so as to meet the specifications mentioned by the API 16 R and API 2 RD standards edited by the American Petroleum Institute.

Figure 3:
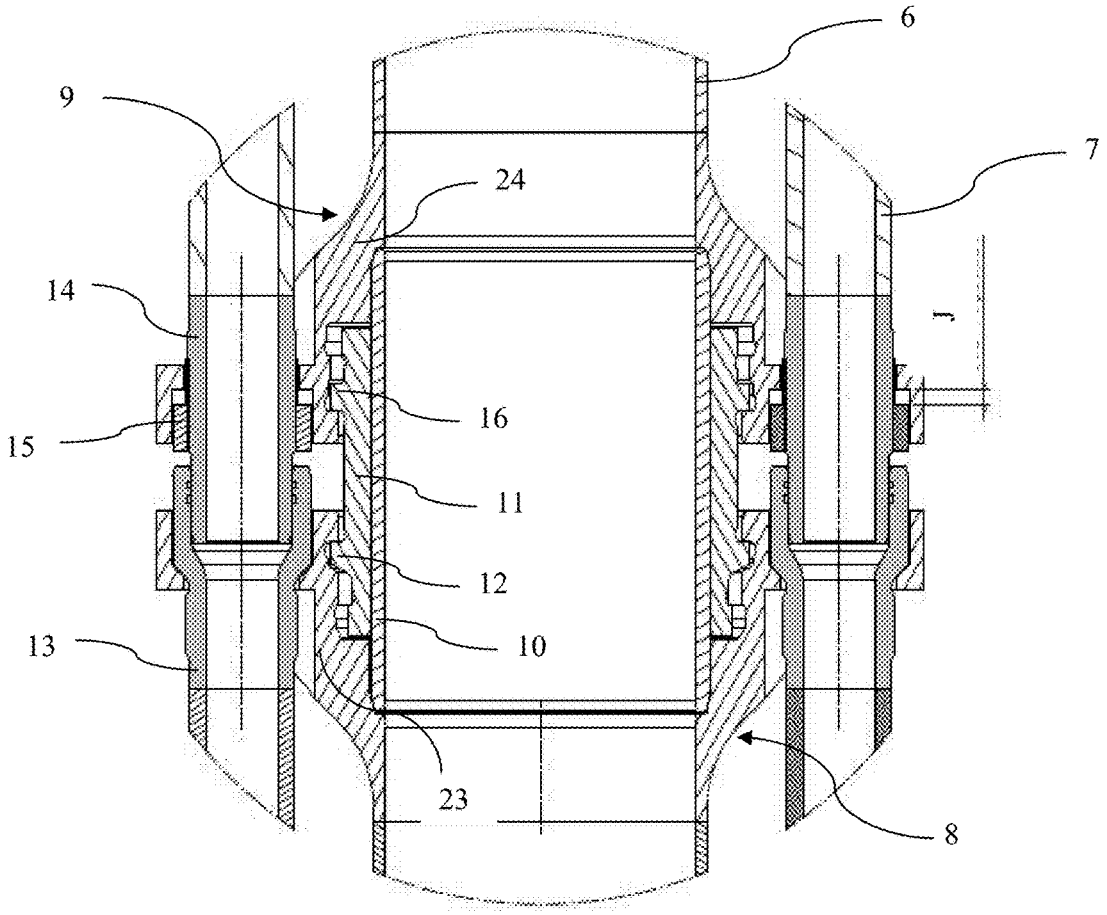
FIG. 3 illustrates the connection of two riser sections according to a first embodiment of the invention.

FIG. 3 shows a male connector element 9 that is fitted in a female connector element 8. A portion of male connector element 9 penetrates inside female connector element 8. This fitting is limited by an axial stop: the end of male connector element 9 comes to rest against the axial shoulder provided on the inner surface of female connector element 8: the axial shoulder provided on the outer surface of male connector element 9 comes to rest against the axial shoulder provided on the inner surface of female connector element 8. As shown in FIGS. 2 and 3, male connector element 9 can comprise a sleeve 10 fastened in the male connector element. Sleeve 10 fulfils a centering and sealing function for the male 9 and female 8 connector elements. Fastening of sleeve 10 can be achieved by welding, by threading, by glueing, by hooping or by any other similar means. Instead of sleeve 10, variant embodiments (not shown) can be considered, such as an extension of main tube element 6.

Connector 5 comprises a locking ring 11 that is positioned between male connector element 9 and female connector element 8, the locking ring is then an inner ring arranged within the female connector element. When male connector element 9 is fitted in a female connector element 8, part of ring 11 penetrates inside female element 8 so that a series of studs 12 provided on the outer surface of ring 11 cooperates with a series of studs provided on the inner face of female element 8. Locking and unlocking of connector 5 is achieved through rotation of ring 11 (bayonet type locking). Ring 11 can be provided with operating means, for example an operating bar that can be dismountable. The operating bar allows ring 11 to be rotated in its housing provided in female connector element 8, about the axis of the main tube. The longitudinal stresses, i.e. the stresses oriented along the axis of the main tube, are transmitted from a section 4 to the adjacent section 4 through the agency of the bayonet type connection between ring 11 and female connector element 8. More precisely, the longitudinal stresses are transmitted from studs 12 of ring 11 to the studs of female connector element 8.

Locking ring 11 is mounted on male connector element 9. According to the embodiment illustrated in FIG. 3, locking ring 11 comprises on the outer face thereof another series of studs 16 cooperating with a series of studs positioned on the inner face of male connector element 9. Thus, locking ring 11 is fastened to the male connector element when riser sections are connected. In an unlocked situation, the ring is secured to the male element by pins (not shown in FIG. 3). Furthermore, this embodiment of locking ring 11 allows to have a connector that can be entirely dismounted so as to facilitate inspection and maintenance thereof. This embodiment also allows to have a ring 11 and male 9 and female 8 connector elements that are nearly symmetrical, which facilitates their manufacture.

In reference to FIG. 3, ring 11 is mounted on the outer surface of sleeve 10. It is secured by the series of studs of the ring and the male 9 and female 8 connector elements. Thus, the axial stresses are transmitted from male connector element 9 to female connector element 8 via the studs without going through sleeve 10.

Alternatively to the bayonet assembly, locking ring 11 is not provided with a series of studs on the male connector 9 side; it is mounted mobile in rotation on male element 9 while being blocked in translation, in particular in the direction of the main tube axis. Locking ring 11 is then secured in a housing defined by shoulders.

Figure 4:
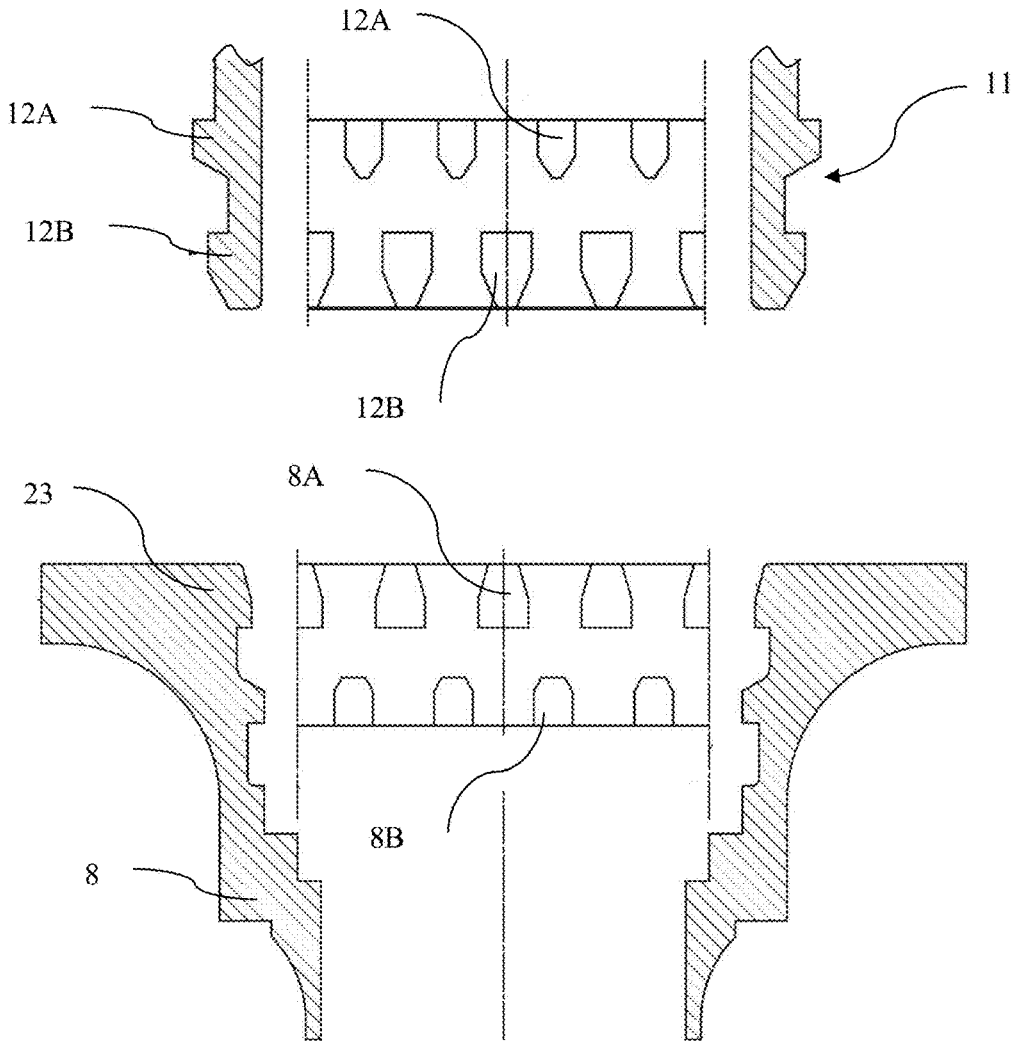
FIG. 4 illustrates an exploded view prior to connection of the locking ring and the female connector element according to the embodiment of FIG. 3.

In reference to FIGS. 3 and 4, female connector element 8 and ring 11 respectively comprise a series of studs consisting of two crowns (or rows) of studs or pegs providing axial locking of connector 5. The studs preferably extend in radial directions. According to a preferred embodiment, each crown (row) of studs comprises four studs. In FIG. 4, female connector element 8 comprises a first crown 8A of four studs and a second crown 8B of four studs. Ring 11 also comprises a first crown 12A of four studs and a second crown 12B of four studs. FIG. 4 only shows the lower part of ring 11, i.e. only the part connected with female connector element 8.

The studs are angularly offset from one crown to the next and they are inscribed in cylindrical surfaces of different radii. For example, the first and second crowns of female connector element 8 are respectively inscribed in cylindrical surfaces of radius r and R (with $r<R$). The first and second crowns of ring 11 are respectively inscribed in cylindrical surfaces of radius r' and R' (with $r'<R'$). Radius r is slightly larger than radius R' so that the studs of the second crown of ring 11 can slide and rotate freely within the cylinder formed by the inner surface of the studs of the first crown of the female connector element.

Studs 12A of the first crown of ring 11 cooperate with studs 8A of the first crown of female connector element 8 so as to form a bayonet assembly. Studs 12B of the second crown of ring 11 cooperate with studs 8B of the second crown of female connector element 8.

More precisely, when ring 11 is engaged in female connector element 8, ring 11 follows a translational motion in the direction of the main tube axis according to the following successive stages:

- second crown 12B of ring 11 moves into first crown 8A of female connector element 8, then
- studs 12B of the second crown of ring 11 fit between studs 8B of the second crown of female connector element 8 and, simultaneously, studs 12A of the first crown of ring 11 fit between studs 8A of the first crown of female connector element 8, then
- when ring 11 reaches the stop, studs 12A of the first crown of ring 11 lodge themselves in a groove (schematized in FIGS. 3 and 4) provided in female connector element 8 between first crown 8A and second crown 8B of female connector element 8, and studs 12B of the second crown of ring 11 lodge themselves in a groove (schematized in FIGS. 3 and 4) provided in female connector element 8 beneath second crown 8B of female connector element 8.

Then, when ring 11 abuts against female connector element 8, ring 11 is pivoted in such a way that the studs of the ring are positioned opposite the studs of the female connector element. Studs 12A of the first crown of ring 11 are positioned opposite the studs of the first crown of female connector element 8 and studs 12B of the second crown of ring 11 are positioned opposite studs 8B of the second crown of female connector element 8. Thus, the studs of ring 11 abut axially with respect to the studs of female connector element 8 and they block the translational motion of female connector element 8 with respect to male connector element 9.

Each one of the two bayonet assembly systems can allow to ensure, between the studs of female element 8 and the studs of ring 11, a contact over a total angle range that can reach 175°. Preferably, the two assembly systems being angularly offset about the axis of the connector, the connector according to the invention allows the axial stresses to be distributed over approximately 350° about the axis.

Alternatively, according to the invention, ring 11 and female connector element 8 may comprise only one crown each: the studs of the single crown of ring 11 cooperate with the studs of the single crown of female connector element 8.

The number of studs per crown can vary, notably as a function of the inner tube diameters and of the stresses to be transmitted by the connector.

According to the embodiment shown in FIG. 3, the bayonet locking system of ring 11 in male connector element 9 using the series of studs 16 is similar to the bayonet locking system used for ring 11 in female connector element 8:

- male connector element 9 and ring 11 respectively comprise two crowns (or rows) of studs or pegs, allowing axial locking of connector 5 to be ensured,
- the studs preferably extend in radial directions,
- the relations between radii r, r', R and R' are also verified so that ring 11 can be inserted in male connector element 9,
- according to a preferred embodiment, each crown (row) of studs comprises four studs.

Figure 5:
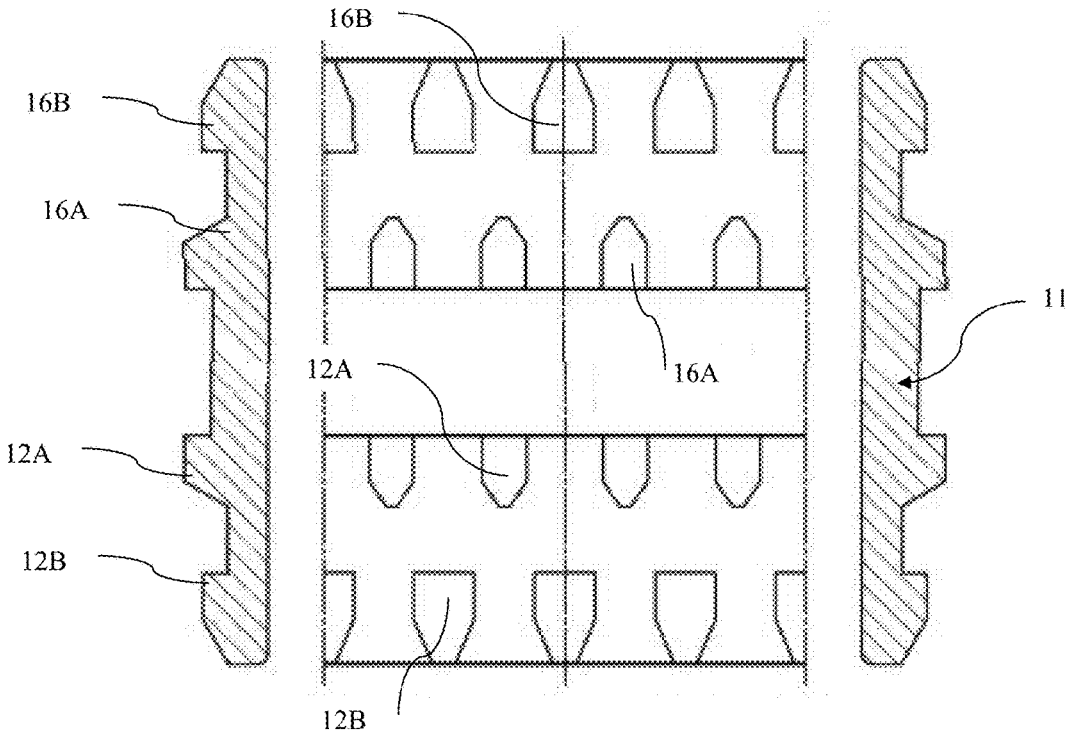
FIG. 5 illustrates a locking ring according to the embodiment of FIG. 3.

FIG. 5 shows a ring 11 according to this embodiment. Locking ring 11 comprises a series of studs 12 suited to cooperate with a female connector element 8 so as to form a bayonet assembly and a series of studs 16 suited to cooperate with a male connector element 9 so as to form a bayonet assembly. Each series of studs can be made up of two crowns comprising four studs. As described in reference to FIG. 4, the series of studs 12 comprises a first crown 12A and a second crown 12B cooperating with two crowns of the female connector element. The series of studs 16 comprises a first crown 16A of studs and a second crown 16B of studs. Advantageously, the series of studs 16 is similar to the series of studs 12, and the connection of the series of studs 16 within male connector element 9 is identical to the connection of the series of studs 12 within female connector element 8. Thus, locking ring 11 is substantially symmetrical. With this assembly, the axial stresses are transmitted from male connector element 9 to female connector element 8 via the studs without going through sleeve 10.

The link connecting ring 11 to male connector element 9 can comprise pins supporting the weight of the ring when the connection is unlocked.

A locking system allows ring 11 to be blocked in rotation.

According to the invention, auxiliary line element 7 is tightly secured with an interlocking link (no relative motion between the parts) at a single end of main tube 6 and it is connected by a sliding pivot connection to the other end of the main tube. In the present application, a sliding pivot connection designates a link connecting a first solid to a second solid, the first solid can translate with respect to the second solid in the direction of an axis and the first solid can pivot with respect to the second solid about this axis. Thus, auxiliary line element 7 can slide and pivot in the axial direction thereof with respect to main tube 6, auxiliary line element 7 cannot move freely in the radial and tangential directions, i.e. in the directions of a perpendicular plane in FIG. 3.

In other words, riser section 4 comprises, at each end thereof, connection means, schematized in FIG. 3, which allow on the one hand to axially link an auxiliary line element 7 to main tube 6 and, on the other hand, to form the sliding pivot connection between auxiliary line element 7 and main tube 6.

According to an embodiment of the invention illustrated in FIG. 3, the interlocking link between auxiliary line element 7 and main tube element 6 is achieved at female connector element 8, and the sliding pivot connection between auxiliary line element 7 and main tube element 6 is achieved at male connector element 9. Alternatively, the interlocking link between auxiliary line element 7 and main tube element 6 is achieved at male connector element 9, and the sliding pivot connection between auxiliary line element 7 and main tube element 6 is achieved at female connector element 8. Only this first variant is described in the rest of the description, and the second variant can be deduced by symmetry.

At the end of the section provided with female connector element 8, main tube 6 is extended by a shoulder or flange 23 comprising a cylindrical passage in which auxiliary line element 7 can slide. Auxiliary line element 7 comprises a stop, for example a nut or a shoulder for axially positioning element 7 with respect to flange 23. When auxiliary line element 7 is mounted on main tube 6, a stop of element 7 rests against flange 23, for example against the axial shoulder provided in the cylindrical passage so as to form an interlocking link with no relative motion between the parts.

At the end of the section provided with male connector element 9, main tube 6 is extended by a shoulder or flange 24 comprising a cylindrical passage in which auxiliary line element 7 can slide and pivot. Auxiliary line element 7 comprises a clearance adjustment means 15 (or adjustable stop) allowing to limit the distance of the relative translational motion between auxiliary line element 7 and flange 24. Clearance adjustment means 15 forms a stop positioned at an adjustable distance J from flange 24. Thus, during mounting, a clearance J is adjusted using clearance adjustment means 15. Then, when the riser is under tension, the relative motion or the deformation of auxiliary line element 7 or of main tube element 6 is limited by a distance J, beyond a certain tension, the clearance becomes zero and auxiliary line element 7 reaches a stop in flange 24.

The female 8 and male 9 connector elements have shapes of revolution about the axis of the main tube element. According to a variant embodiment of the invention, flanges 23 and 24 can comprise reinforcements positioned perpendicular to some auxiliary lines (choke line and kill line for example). According to the invention, connector elements 8 and 9 extend main tube element 6 by increasing the thickness and the outer section of the tube so as to form shoulders or flanges 23 and 24 respectively. Preferably, the outer section of connector elements 8 and 9 varies progressively along axis 8 so as to prevent a sudden section variation between tube 6 and shoulders 23 and 24 that might weaken the mechanical strength of connector 5. For example, in reference to FIG. 2, flanges 23 and 24 form fillets.

Auxiliary lines 7 undergo axial compressive stresses caused by the internal/external pressure difference that generates an "end effect" applied onto the tube ends (for example, the auxiliary lines can undergo pressures of the order of 1034 bar, i.e. 15,000 psi). Under such pressures, the main tube elements lengthen and the auxiliary line elements shorten until clearance J is zero. When clearance J becomes zero, all the lines lengthen identically. Main tube elements 6 are likely to lengthen because they have to take up, totally or partly, the weight of the riser and the weight of the drilling mud on the one hand, and the tensile stresses imposed on the riser to keep it substantially vertical on the other hand. In general, the main tube elements at the top of the riser, i.e. close to the sea surface, undergo maximum tensile stresses, hence maximum elongation. Auxiliary line elements 7 are likely to shorten under the effect of the difference between the internal pressure and the external pressure due to the fluid they contain. Indeed, the fluid applies a pressure onto the ends of auxiliary line elements 7 by imposing compressive stresses on auxiliary line elements 7. Furthermore, the radial deformation of the tube due to the internal/external pressure difference causes shortening of the tube. In general, elements 4 at the foot of the riser, i.e. close to the sea bed, undergo the maximum internal/external pressure difference, therefore maximum shortening.

As long as clearance J is positive, the length of auxiliary line element 7 and of main tube element 6 positioned at the same height can vary independently of one another. On the other hand, when clearance J becomes zero, i.e. when clearance adjustment means 15 is in contact with flange 24, auxiliary line element 7 and the corresponding main tube element 6 form a hyperstatic assembly: auxiliary line element 7 is secured to main tube element 6 on the one hand at fastening means and, on the other hand, at the stop that is in contact with flange 24. Therefore, main tube element 6 induces tensile stresses in auxiliary line element 7, and vice versa.

Thus, these links allow to distribute the tensile stresses applied onto each riser section among main tube 6 and auxiliary line elements 7, while preventing buckling of auxiliary line elements 7. The integration according to the invention via the establishment of clearance J allows to increase the contribution of the main tube and consequently to reduce the axial stresses in the peripheral lines. Reduction of the axial stresses in the peripheral lines by means of this integration is beneficial for the dimensioning of the end pieces and of the thickness of the auxiliary lines.

Advantageously, clearance J is selected as a function of the length of the section; indeed, the deformations of the various lines depend on the length thereof. For a conventional 75 or 90 ft (22.86 m and 27.43 m) riser section, clearance J is set between 0 and 1.5 inch (0 and approximately 38.1 mm). Preferably, clearance J is selected between 0.1 and 1 inch (2.54 and 25.4 mm) for optimal distribution of the stresses in the lines, allowing to generate a decrease in the mass of the riser. Alternatively, clearance J is selected between 0.1 and 0.25 inch (2.54 and 6.35 mm). According to one alternative, clearance J is selected between 0.25 and 1 inch (6.35 and 25.4 mm). A preferred option providing a good compromise is a clearance of approximately 0.5 inch (12.7 mm) or 1 inch (25.4 mm).

According to the invention, clearance adjustment means 15 is made up of a nut or a threaded element. Clearance J is adjusted (prior to connection of the sections) as a function of the stresses and pressures applied on main tube elements 6 and auxiliary line elements 7. The presence of a clearance is beneficial for the dimensioning of the end pieces of the peripheral lines and of the thickness of the auxiliary lines.

Figure 8:
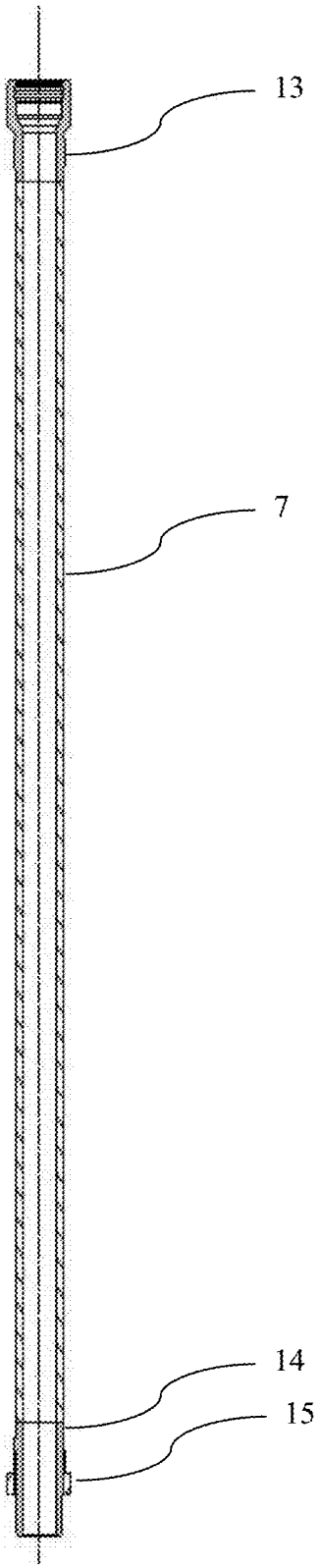
FIGS. 8 to 10 show three variant embodiments according to the invention of an auxiliary line.
Figure 9:
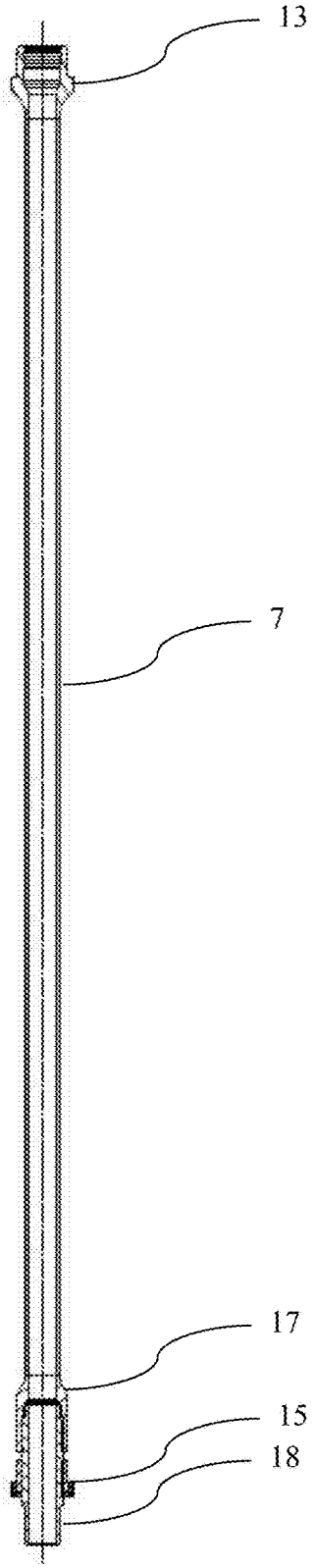
Figure 10:
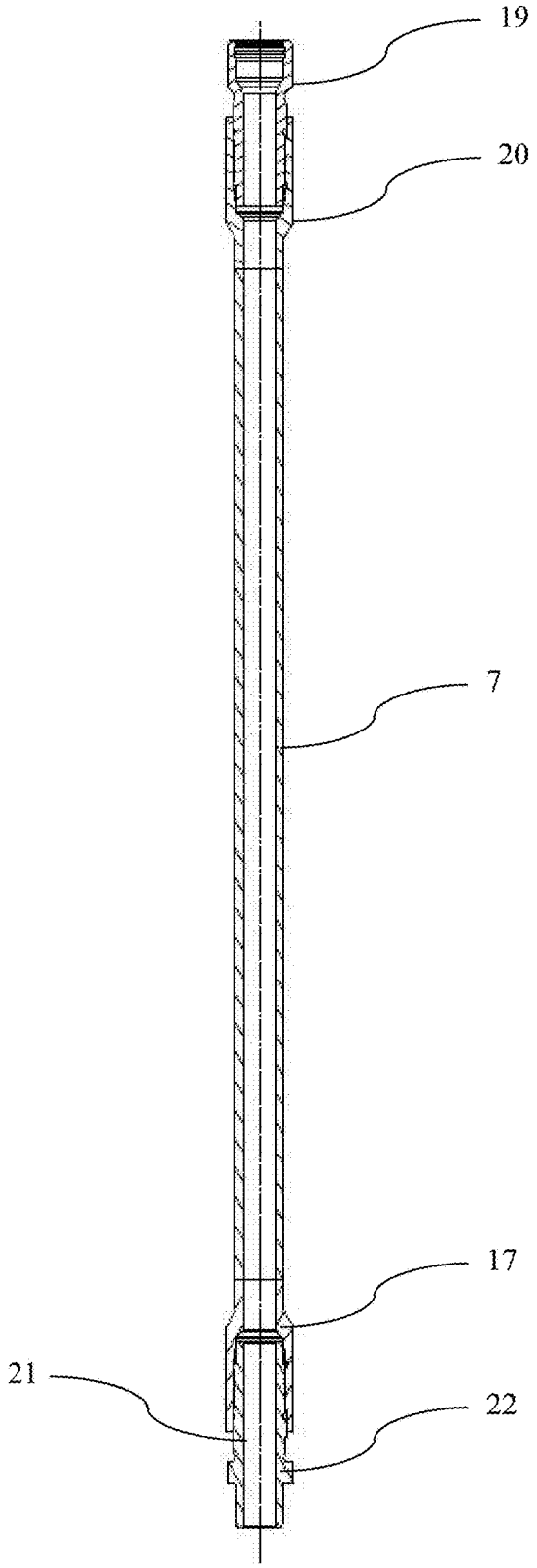

FIGS. 8 to 10 illustrate three variant embodiments of auxiliary line element 7 equipped with clearance adjustment means.

According to a first variant embodiment of the invention illustrated in FIGS. 2, 3, 6 and 8, auxiliary line elements 7 are connected end to end by connections. A connection is made up of a male end piece 14 arranged at one end of element 7 and of a female end piece 13 arranged at the other end of element 7. A male end piece 14 cooperates tightly with female end piece 13 of another element 7. For example, male end piece 14 of the connection is a tubular part that fits into another tubular part 13. The inner surface of female end piece 13 is adjusted to the outer surface of male end piece 14. Joints are mounted in grooves machined on the inner surface of female end piece 13 so as to provide a sealed link. The connection allows axial displacement of one of elements 7 with respect to the other, while maintaining the sealed link between the two elements. The male 14 and female 13 end pieces are fastened for example through welding or crimping to a central tube of substantially same length as main tube element 6 to which auxiliary line element 7 is secured. For this variant embodiment of the invention, the clearance adjustment means consists of a nut 15 positioned on male end piece 14, on a threaded portion that is not intended to be inserted in a female end piece 13.

According to a second variant embodiment of the invention illustrated in FIG. 9, auxiliary line elements 7 are connected end to end by means of connections. A connection consists of a male pin 18 inserted in a receptacle 17 at one end of element 7 and of a female end piece 13 arranged at the other end of element 7. Male pin 18 tightly cooperates with female end piece 13 of another element 7. For example, male pin 18 of the connection is a tubular part that fits into another tubular part 13. The inner surface of female end piece 13 is adjusted to the outer surface of male pin 18. Joints are mounted in grooves machined on the inner surface of female end piece 13 so as to provide a sealed link. The connection allows axial displacement of one of elements 7 with respect to the other, while maintaining the sealed link between the two elements. Female end piece 13 is for example fastened through welding or crimping to a central tube of substantially same length as main tube element 6 to which auxiliary line element 7 is secured. Receptacle 17 is for example fastened through welding or crimping to the central tube. Male pin 18 is fastened to receptacle 17 notably through screwing. Thus, male pin 18 is a wearing part that can be changed during riser maintenance. For this variant embodiment of the invention, the clearance adjustment means consists of a nut 15 positioned on male pin 18, on a threaded portion that is not intended to be inserted in a female end piece 13.

According to a third variant embodiment of the invention illustrated in FIG. 10, auxiliary line elements 7 are connected end to end by connections. A connection consists of a male pin 21 inserted in a receptacle 17 at one end of element 7 and of a female pin 19 inserted in a receptacle 20 arranged at the other end of element 7. Male pin 21 tightly cooperates with female pin 19 of another element 7. For example, male pin 21 of the connection is a tubular part that fits into another tubular part 19. The inner surface of female pin 19 is adjusted to the outer surface of male pin 21. Joints are mounted in grooves machined on the inner surface of female pin 19 so as to provide a sealed link. The connection allows axial displacement of one of elements 7 with respect to the other, while maintaining the sealed link between the two elements. Receptacle 20 is for example fastened through welding or crimping to a central tube of substantially same length as main tube element 6 to which auxiliary line element 7 is secured. Female pin 19 is fastened to receptacle 20 notably through screwing. Receptacle 17 is for example fastened through welding or crimping to the central tube. Male pin 21 is fastened to receptacle 17 notably through screwing. Thus, the male 21 and female 19 pins are wearing parts that can be changed upon riser maintenance. For this embodiment of the invention, the clearance adjustment means consists of male pin 21 that is threaded in the receptacle and has a shoulder 22 providing the stop.

According to an embodiment of the invention, auxiliary line elements 7 are hooped tubes with reinforcement wires such as glass, carbon or aramid fibers, coated with a polymer matrix. Thus, the resistance and the weight of the auxiliary lines are optimized. Indeed, the present invention is particularly well suited for hooped auxiliary line elements that afford the advantage of reducing the steel thickness and therefore the weight of the riser. The drawback of hooping, which involves lower flexural rigidity, is compensated by the clearance that allows buckling of the auxiliary lines to be limited. Alternatively, the main tube and auxiliary line elements can be made of aluminium alloy or titanium alloy.

Positioning ring 11 between male connector element 9 and female connector element 8 enables more compact layout of connector 5. The position of ring 11 allows to reduce the space requirement for the connector in the radial direction. Therefore, the distance from the main tube axis of elements 7 arranged on the periphery of connector 5 can be limited. The reduced space between element 7 and axis AA' therefore allows the bending stresses undergone by flanges 23 and 24 to be minimized. Indeed, flanges 23 and 24 transmit and thus bear the longitudinal stresses that are taken up by elements 7. The distance of elements 7 from the axis forms a lever arm which, coupled with the longitudinal stresses taken up by elements 7, induces bending stresses in flanges 23 and 24. The compact connector according to the invention enables to minimize the bending stresses in the flanges and thus to reduce the dimensions of flanges 23 and 24, as well as the weight of the connectors.

Furthermore, the device according to the invention provides an interesting solution for rapidly and simply mounting a riser whose tensile stresses are distributed among the auxiliary line elements and the main tube. Indeed, although auxiliary line elements 7 and main tube elements 6 are mounted so as to jointly bear the tensile stresses undergone by the riser, connection of a riser section 4 to another riser section 4 is achieved in one operation by means of ring 11. This connection allows to communicate and to seal the main tube element of a section with that of the other section and, simultaneously, to communicate and to seal the auxiliary line elements of one of the sections with those of the other section.

Besides, the fact that ring 11 is positioned between male connector element 9 and female connector element 8 allows the strength of the connector to be increased. Indeed, ring 11 is held mechanically on the inner side through the housing provided in female connector element 8. Furthermore, in locked position, the studs of ring 11 are engaged with the studs of female connector element 8 that are positioned on the massive part of female connector element 8.

Therefore, the combination of locking with an inner ring and of the existence of a clearance in the connection of the auxiliary line elements allows the weight of the riser to be optimized.

Variant Embodiment

According to a second embodiment of the invention, the riser section also comprises a locking collar for connection of two consecutive sections. This locking collar is referred to as external or peripheral because it cooperates with the periphery of the flanges of the male and female connector elements so as to assemble them. Thus, two consecutive sections are assembled by two elements: an inner locking ring and a peripheral locking collar, in order to transmit axial stresses.

Figure 6:
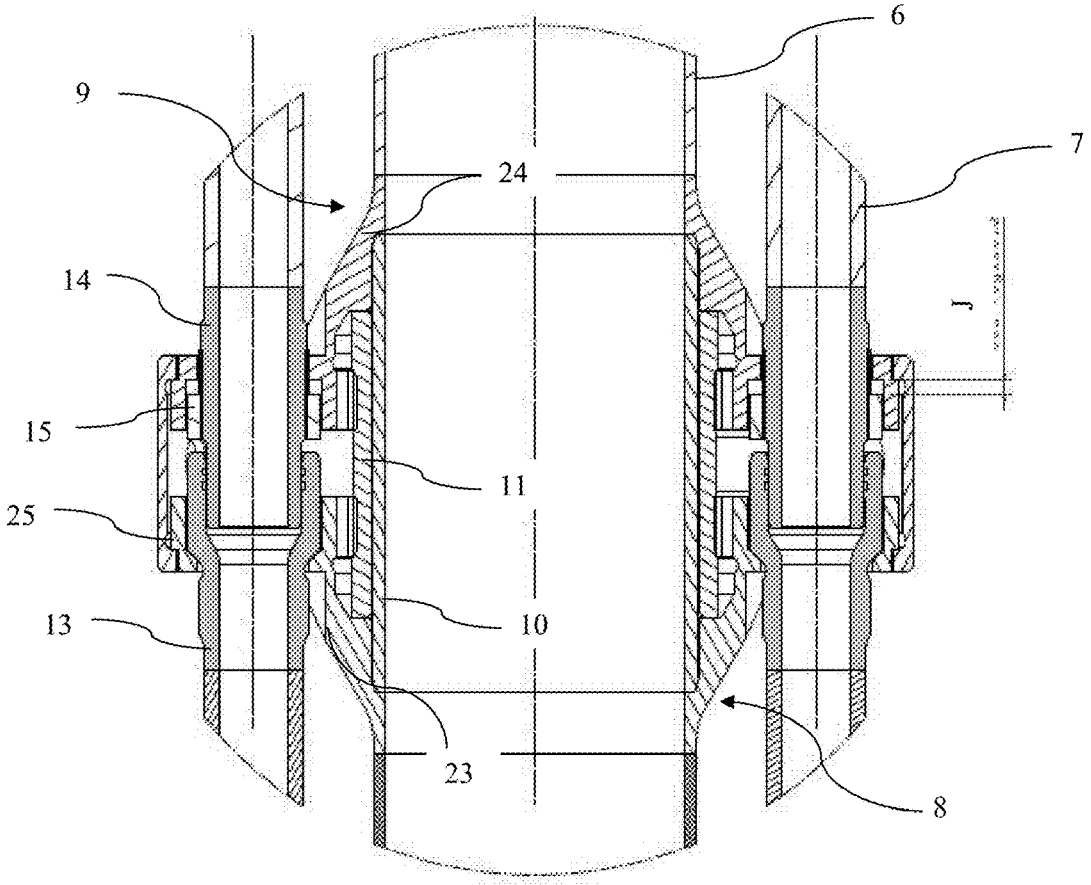
FIG. 6 illustrates the connection of two riser sections according to a second embodiment of the invention.

FIG. 6 illustrates the second embodiment of the invention. The elements identical to the first embodiment are designated by the same reference signs. As in the first embodiment illustrated notably by FIG. 3, a male connector element 9 is fitted in a female connector element 8. A portion of male connector element 9 penetrates inside female connector element 8. This fitting is limited by an axial stop: the end of male connector element 9 comes to rest against the axial shoulder provided on the inner surface of female connector element 8. As illustrated in FIG. 6, male connector element 9 can comprise a sleeve 10 fastened in the male connector element. Sleeve 10 fulfils a centering and sealing function for the male 9 and female 8 connector elements. Fastening of sleeve 10 can be achieved by welding, by threading, by glueing, by hooping or by any other similar means. Instead of sleeve 10, variant embodiments (not shown) can be considered, such as an extension of main tube element 6.

Connector 5 comprises a locking ring 11 that is positioned between male connector element 9 and female connector element 8; the locking ring is then an inner ring arranged within the female connector element. When male connector element 9 is fitted in female connector element 8, a part of ring 11 penetrates inside female element 8 in such a way that a series of studs 12 provided on the outer surface of ring 11 cooperates with a series of studs provided on the inner face of female element 8. Locking ring 11 is mounted on male connector element 9. As illustrated in FIG. 6, locking ring 11 comprises on the outer face thereof another series of studs 16 cooperating with a series of studs positioned on the inner face of male connector element 9. Thus, locking ring 11 is fastened to the male connector element when riser sections are connected. In an unlocked situation, the ring is secured to the male element by pins (not shown in FIG. 6). Furthermore, this embodiment of locking ring 11 allows to have a connector that can be entirely dismounted so as to facilitate inspection and maintenance thereof. This embodiment also enables to have a ring 11 and male 9 and female 8 connector elements that are nearly symmetrical, which facilitates their manufacture.

In reference to FIG. 6, ring 11 is mounted on the outer surface of sleeve 10. It is secured by the series of studs of the ring and the male 9 and female 8 connector elements. Alternatively to the bayonet assembly, locking ring 11 is not provided with a series of studs on the male connector 9 side; it is mounted mobile in rotation on male element 9, while being blocked in translation, in particular in the direction of the main tube axis. Locking ring 11 is thus held in a housing defined by shoulders.

For this second embodiment of the invention, connector 5 additionally comprises a locking collar 25 that is positioned on the outer (peripheral) surface of flanges 23 and 24. Collar 25 can be machined in a tube portion. Collar 25 is provided at each end thereof with stops that respectively cooperate with flanges 23 and 24 so as to block the translational motion, along the axis of the main tube, of flanges 23 and 24. Locking collar 25 is mounted mobile in rotation on flange 24 while being blocked in translation in the direction of the main tube axis. In reference to FIG. 6, collar 25 comprises at least a portion of cylindrical inner surface of radius S and the outer peripheral surface of flange 23 is cylindrical with a radius slightly smaller than S. Collar 25 is mounted on flange 24 by centering the inner cylindrical surface of the collar on the outer cylindrical surface of flange 24. Moreover, collar 25 comprises a neck forming a radial recess of the cylindrical inner surface of collar 25. The inner surface of collar 25 comprises studs. Flange 23 of the female connector element also comprises studs arranged on the outer peripheral surface thereof. When male connector element 9 is fitted in female connector element 8, part of collar 25 covers flange 23 so that the studs of collar 25 can cooperate with the studs of flange 23 of female connector element 8.

Assembly by means of a peripheral collar 25 provides great stiffness of the locking system, which allows to limit deformations (bending notably) of the flanges. Furthermore, double locking provides the connector with the capacity to transmit significant stresses. Moreover, this design with double bayonet connection (male connector element side and female connector element side) allows the connector to be entirely dismountable for inspection and maintenance, and it also enables near-symmetry of the flanges, which facilitates manufacture thereof.

As illustrated in FIG. 6, locking collar 25 additionally comprises a second series of studs on the inner surface thereof and the peripheral outer surface of flange 24 of male connector element 9 also comprises studs suited to cooperate with the studs of locking collar 25.

Figure 7:
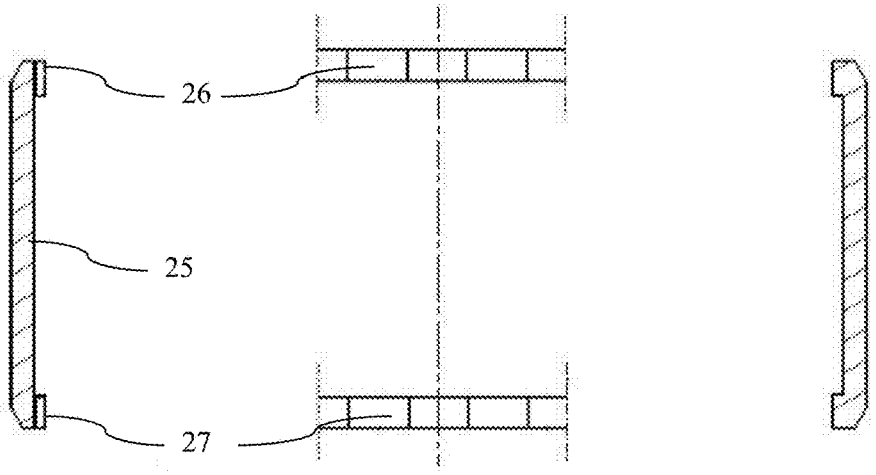
FIG. 7 illustrates a locking collar for the second embodiment of the invention.

FIG. 7 shows a peripheral locking collar 25. Locking collar 25 comprises a first series of studs 27 suited to cooperate with studs of a flange 23 of a female connector element 8 and a second series of studs suited to cooperate with studs of a flange 24 of a male connector element 9.

Locking and unlocking of connector 5 is achieved through rotation of collar 25 and rotation of locking ring 11 (bayonet type locking). Collar 25 and ring 11 are provided with operating means, for example an operating bar that can be dismountable. The operating means allow collar 25 to be pivoted around flanges 23 and 24 along the main tube axis and, independently or simultaneously, ring 11 to be pivoted along the main tube axis. To achieve simultaneous rotation of the collar and the ring, collar 25 can be secured to ring 11 by a rigid link (for example by means of rods or of a hollowed plate preventing interference with the auxiliary lines upon rotation of the locking ring/collar assembly).

Rotation stop means and means for holding the ring/collar system in locked and unlocked position can be provided, for example blocks, pins, punches or screws arranged on flange 24 and collar 25.

The longitudinal stresses, i.e. the tensile stresses oriented along the axis of the main tube, are transmitted from a section 4 to the adjacent section 4 on the one hand through the agency of the bayonet type connection between collar 25 and flanges 23 and 24 and, on the other hand, through the agency of the bayonet type connection between ring 11 and the male 9 and female 8 connector elements.

The layout of the connector according to the invention allows to transmit nearly all of the stresses in the main tube by means of inner ring 11, while the stresses in the auxiliary lines are transmitted partly via inner ring 11 and partly via outer collar 25. Indeed, for this embodiment, the stresses are transmitted from flange 24 of male connector element 9 to flange 23 of female connector element 8 via the studs of ring 11 and collar 25 without going through sleeve 10. The distribution of the stresses among ring 11 and collar 25 depends on the stiffness and on the stresses in the lines.

The height of collar 25 can be determined in such a way that the distance between the lower face of the circular neck and the upper face of studs 26, 27 is equal to the distance between flanges 23 and 24 increased by a clearance at least equal to that of inner ring 11. Furthermore, a space is necessary between the two flanges 23 and 24 for housing connections 13, 14 of auxiliary lines 7 and clearance adjustment means 15.

Openings can be provided in the parts of collar 25 positioned, vertically and circumferentially, between the studs. These openings enable, on the one hand, to reduce the weight of the part, and also and above all to see the ends of auxiliary line elements 7 as they are being connected and thus to prevent damage that would result from a blind approach.

According to the invention, auxiliary line element 7 is tightly secured with an interlocking link (no relative motion between the parts) at a single end of main tube 6 and it is connected by a sliding pivot connection to the other end of the main tube. In the present application, a sliding pivot connection designates a link connecting a first solid to a second solid, the first solid can translate with respect to the second solid in the direction of an axis and the first solid can pivot with respect to the second solid about this axis. Thus, auxiliary line element 7 can slide and pivot in the axial direction thereof with respect to main tube 6, and auxiliary line element 7 cannot move freely in the radial and tangential directions, i.e. in the directions of a perpendicular plane to FIG. 3.

In other words, riser section 4 comprises, at each end thereof, connection means, schematized in FIG. 6, which allow on the one hand to axially link an auxiliary line element 7 to main tube 6 and, on the other hand, to form the sliding pivot connection between auxiliary line element 7 and main tube 6.

According to an embodiment of the invention illustrated in FIG. 6, the interlocking link between auxiliary line element 7 and main tube element 6 is achieved at female connector element 8, and the sliding pivot connection between auxiliary line element 7 and main tube element 6 is achieved at male connector element 9. Alternatively, the interlocking link between auxiliary line element 7 and main tube element 6 is achieved at male connector element 9, and the sliding pivot connection between auxiliary line element 7 and main tube element 6 is achieved at female connector element 8. Only this first variant is described in the rest of the description, and the second variant can be deduced by symmetry.

At the end of the section provided with female connector element 8, main tube 6 is extended by a shoulder or flange 23 comprising a cylindrical passage in which auxiliary line element 7 can slide. Auxiliary line element 7 comprises a stop, for example a nut or a shoulder for axially positioning element 7 with respect to flange 23. When auxiliary line element 7 is mounted on main tube 6, a stop of element 7 rests against flange 23, for example against the axial shoulder provided in the cylindrical passage so as to form an interlocking link with no relative motion between the parts.

At the end of the section provided with male connector element 9, main tube 6 is extended by a shoulder or flange 24 comprising a cylindrical passage in which auxiliary line element 7 can slide and pivot. Auxiliary line element 7 comprises a clearance adjustment means 15 (or adjustable stop) allowing to limit the relative motion between auxiliary line element 7 and flange 24. Clearance adjustment means 15 forms a stop positioned at an adjustable distance J from flange 24. Thus, during mounting, a clearance J is adjusted using clearance adjustment means 15. Then, when the riser is under tension, the relative motion or the deformation of auxiliary line element 7 or of main tube element 6 is limited by a distance J, beyond a certain tension, the clearance becomes zero and auxiliary line element 7 reaches a stop in flange 24.

According to the invention, clearance adjustment means 15 consists of a nut or a threaded element. Clearance J is adjusted (prior to connection of the sections) as a function of the stresses and pressures applied on main tube elements 6 and auxiliary line elements 7. The presence of a clearance is beneficial for the dimensioning of the end pieces of the peripheral lines and of the thickness of the auxiliary lines.

According to the variant embodiment illustrated in FIG. 6 (corresponding to the embodiment of FIG. 8), auxiliary line elements 7 are connected end to end by means of connections. A connection is made up of a male end piece 14 arranged at one end of element 7 and of a female end piece 13 arranged at the other end of element 7. A male end piece 14 cooperates tightly with female end piece 13 of another element 7. For example, male end piece 14 of the connection is a tubular part that fits into another tubular part 13. The inner surface of female end piece 13 is adjusted to the outer surface of male end piece 14. Joints are mounted in grooves machined on the inner surface of female end piece 13 so as to provide a sealed link. The connection allows axial displacement of one of elements 7 with respect to the other, while maintaining the sealed link between the two elements. The male 14 and female 13 end pieces are fastened for example through welding or crimping to a central tube of substantially same length as main tube element 6 to which auxiliary line element 7 is secured. For this variant embodiment of the invention, the clearance adjustment means consists of a nut 15 positioned on male end piece 14, on a threaded portion that is not intended to be inserted in a female end piece 13.

Alternatively, the connections of the auxiliary line elements are identical to those of FIGS. 9 and 10.

Application Example

An application example according to the invention is presented in order to describe the stress distribution and the mass gain in a riser according to the invention.

For this example (according to FIG. 3), the conditions are as follows:

Water depth: 12,500 ft (3810 m)

Maximum mud density: 14.5 ppg (1.74)

Auxiliary lines operating pressure: 15,000 psi (1034 bar)

Maximum working load of the connector: 4,000 kips (1814 t)

Length of the riser sections: 75 ft (22.86 m)

Tapered riser architecture: 7 sections of variable thickness for the main tube.

Table 1 gives the stress distribution in the main tube and in the auxiliary lines: kill line, choke line, booster line, hydraulic line, as a function of clearance J in inches.

TABLE 1

Distribution of the stresses in the riser

| | Clearance J (inches) | | | | | | |
|---|---|---|---|---|---|---|---|
| | 0 | 0.25 | 0.5 | 1 | 1.5 | 2 | 2.5 |
| Main tube | 45% | 50% | 55% | 67% | 82% | 97% | 100% |
| Kill line | 20% | 18% | 16% | 12% | 7% | 1% | 0% |
| Choke line | 20% | 18% | 16% | 12% | 7% | 1% | 0% |
| Booster line | 7% | 6% | 6% | 4% | 1% | 0% | 0% |
| Hydraulic line | 4% | 4% | 3% | 2% | 1% | 0% | 0% |

It can be seen that the distribution varies in the sense of a greater contribution of the main tube when the clearance increases. Between a zero clearance and a 1-inch (25.4 mm) clearance, the stress distribution among the main tube and the peripheral lines shifts from 45%-55% to 67%-33% respectively. Above 2 inches (50.8 mm), one considers that there is no more stress distribution among the various lines, only the main tube takes part in the taking up of the stresses, which is not desirable.

Figure 11:
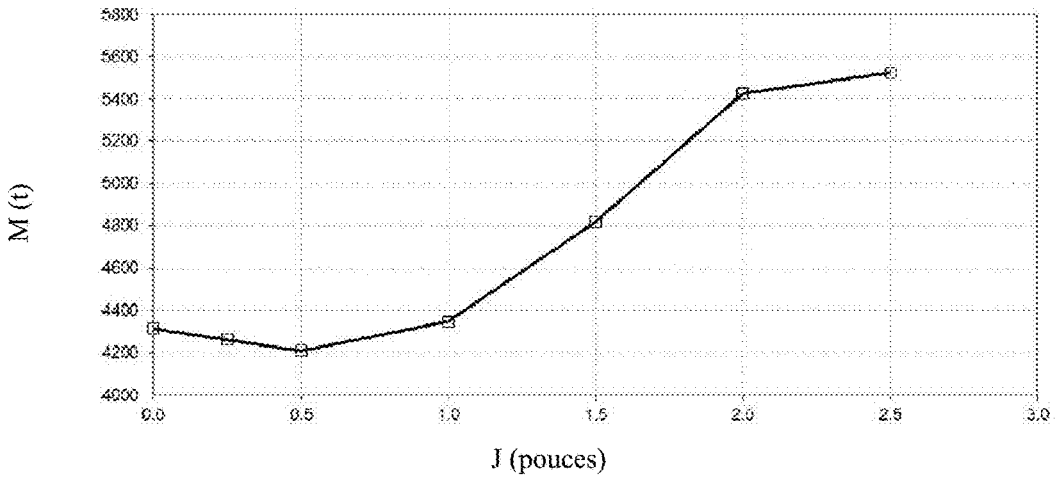
FIG. 11 is a curve showing the mass of the riser as a function of the clearance for an example according to the invention.

FIG. 11 shows the mass M in tons of the riser as a function of clearance J in inches for this example. For this curve, the thicknesses of the main tube and of the auxiliary lines have been optimized so as to meet the aforementioned conditions. It can be observed that the mass is minimal between 0 and 1 inch (25.4 mm) and that a mass optimum is obtained with a clearance of 0.5 inch (12.7 mm). Above 1.25 inch (31.75 mm), the mass of the riser increases significantly, which leads to an increase in the cost of the riser.

Considering the stress distribution and the mass variation as a function of the clearance, the clearance can be set between 0 and 1.25 inch (0 and 31.75 mm) for this example according to the invention. Preferably, the clearance can be set between 0.1 and 1 inch (2.54 mm and 25.4 mm). Optimally, the clearance can be 0.5 inch (12.7 mm).

The invention claimed is:

1. A riser section comprising a main tube element extended by a male connector element and by a female connector element comprising a first series of studs on the inner face of the female connector element, wherein a locking ring is mounted on said male connector element, the outer surface of said locking ring comprising at least a second series of studs, said riser section additionally comprising at least one auxiliary line element, characterized in that said auxiliary line element is secured to one end of said main tube element and it is connected by a sliding pivot connection to the other end of said main tube element, said sliding pivot connection allowing a relative translational motion between said main tube element and said auxiliary line element over a distance limited by a clearance adjustment means arranged on said auxiliary line element, the clearance adjustment means being configured to allow adjustment of the distance of the relative translational motion between said main tube element and said auxiliary line element.

2. A section as claimed in claim 1, wherein said clearance adjustment means consists of a nut or a threaded part.

3. A section as claimed in claim 2, wherein said auxiliary line element is extended on the one hand by a female end piece and, on the other hand, by a male end piece provided with a nut.

4. A section as claimed in claim 2, wherein said auxiliary line element is extended on the one hand by a female end piece and, on the other hand, by a receptacle in which a male pin provided with a stop is inserted.

5. A section as claimed in claim 2, wherein said auxiliary line element is extended on the one hand by a receptacle in which a female pin is inserted and, on the other hand, by a receptacle in which a male threaded pin is screwed, said male threaded pin comprising a shoulder.

6. A section as claimed in claim 1, wherein said distance limited by said clearance adjustment means ranges between 0 mm and 38.1 mm, preferably between 2.54 mm and 25.4 mm.

7. A section as claimed in claim 1, wherein said male connector element comprises a sleeve on which said locking ring is mounted.

8. A section as claimed in claim 1, wherein said male connector element comprises a third series of studs on the inner face thereof, and the outer surface of said locking ring comprises a fourth series of studs suited to cooperate with said third series of studs.

9. A section as claimed in claim 1, wherein each series of studs is made up of at least two rows of at least four studs.

10. A section as claimed in claim 1, wherein said auxiliary line element is a hooped steel tube with reinforcement wires such as glass, carbon or aramid fibers, coated with a polymer matrix.

11. A section as claimed in claim 1, wherein said male and female connector elements extend the main tube element by increasing the section and the thickness of said main tube element so as to form flanges for passage of said auxiliary line element.

12. A section as claimed in claim 11, wherein said sliding pivot connection is achieved in a flange of said male connector element.

13. A section as claimed in claim 11, wherein said riser section comprises a locking collar cooperating with the peripheral surfaces of said flanges for assembling said flanges.

14. A section as claimed in claim 13, wherein the inner face of said locking collar is provided with a first series of studs and the peripheral surface of flange of said female connector element comprises a second series of studs.

15. A section as claimed in claim 14, wherein the inner face of said locking collar is provided with a third series of studs and the peripheral surface of flange of said male connector element comprises a fourth series of studs suited to cooperate with said third series of studs.

16. A section as claimed in claim 13, wherein said locking collar is rotationally secured to said locking ring.

17. A riser pipe comprising at least two riser sections as claimed in claim 1, for which the connection between two consecutive sections is achieved by means of said male and female connector elements and of said locking ring.

18. A riser pipe as claimed in claim 17, wherein said distance of the relative translational motion of said sliding pivot connection is adjusted so as to be positive upon connection of at least two sections of said riser and to be zero while using said riser.

19. A method for carrying out an offshore drilling operation, comprising connecting a wellhead to a floater with the riser pipe as claimed in claim 17.

20. A riser section, comprising:

a main tube element extended by a male connector element;

a female connector element comprising a first series of studs on the inner face female connector element;

a locking ring mounted on said male connector element, the outer surface of said locking ring comprising at least a second series of studs;

at least one auxiliary line element secured to one end of said main tube element;

a sliding pivot connection connecting said auxiliary line element to the other end of said main tube element, said sliding pivot connection allowing a relative translational motion between said main tube element and said auxiliary line element over a distance; and an adjustable stop arranged on said auxiliary line element, said adjustable stop being configured to allow adjustment of the distance of the relative translational motion between said main tube element and said auxiliary line element.

* * * * *